United States Patent [19]

Stone

[11] Patent Number: 4,581,995

[45] Date of Patent: Apr. 15, 1986

[54] INK SEALING ASSEMBLY

[75] Inventor: Rex D. Stone, York, Pa.

[73] Assignee: Motter Printing Press Co., York, Pa.

[21] Appl. No.: 742,544

[22] Filed: Jun. 7, 1985

[51] Int. Cl.[4] ..... B41F 31/06; B41L 27/06

[52] U.S. Cl. ..... 101/366

[58] Field of Search ..... 101/366, 364, 363, 350, 101/207-210, 148; 118/259, 261

[56] References Cited

U.S. PATENT DOCUMENTS

| | | | |
|---|---|---|---|
| 2,744,464 | 5/1956 | Harless | 101/157 |
| 2,931,297 | 4/1960 | Coudriet | 101/157 |
| 3,815,499 | 6/1974 | Abler | 101/169 X |

FOREIGN PATENT DOCUMENTS

| | | | |
|---|---|---|---|
| 128411 | 12/1984 | European Pat. Off. | 101/366 |

*Primary Examiner*—J. Reed Fisher

*Attorney, Agent, or Firm*—Brumbaugh, Graves, Donohue & Raymond

[57] ABSTRACT

An ink sealing assembly for a printing press in which ink is circulated from a reservoir into an ink chamber where it is retained under pressure in engagement with a rotating cylinder and in which the ink sealing assembly includes a pressure barrier communicating with the ink chamber, at least one ink seal spaced apart from the pressure barrier on the side remote from the ink chamber, said pressure barrier and ink seal being formed of relatively stiff but flexible, polymeric material with their sealing edges engaging the doctor blade and the cylinder and a return conduit connecting the space between the pressure barrier and the ink seal with the reservoir.

12 Claims, 3 Drawing Figures

INK SEALING ASSEMBLY

BACKGROUND OF THE INVENTION

This invention relates to a printing press, for example, a printing press in which ink is circulated from a reservoir into an ink chamber where it is retained under pressure in engagement with a rotating cylinder and returned through a return conduit to the reservoir, and more particularly, to an ink sealing assembly for a printing press of this type.

A printing press of the type for which the ink sealing assembly of the present invention is adapted is disclosed in U.S. Pat. No. 4,497,250, issued Feb. 5, 1985. In this press, the ink chamber is accommodated in an ink fountain, and a doctor blade and ink dam are clamped in the ink fountain. The doctor blade and the ink dam define the upper and lower ink barriers for the ink chamber. The ink is supplied to the ink chamber under pressure and the ink is applied to the surface of the rotating inking cylinder as it passes in open communication with the ink chamber.

Ink seals are provided at both ends of the ink fountain to prevent ink from leaking from the ink chamber to the unused surfaces at the extreme ends of the cylinder. Such leakage of ink will not only foul and damage the equipment, but the cylinder will sling the ink outwardly unless the slinging of the ink is retained by a shield and retained within the confines of the press.

There are occasions when more than one color of ink is run in the fountain. On these occasions, the ink chamber will be divided into sections which apply different ink colors to the cylinder. This fountain arrangement is referred to as a "split" fountain where there are pairs of end seals for each color. These seals must not allow a color from one section to leak into a color of an adjacent section. Moreover, the seal widths must be narrow enough to fit within the margins between pages.

The ink seals must be able to provide an effective seal against three independent movable surfaces, namely, the outer periphery of the rotating cylinder, the doctor blade which engages the cylinder surface and is bendable and deflectable along its length and the ink dam which also flexes as it engages the cylinder. The ink seals must not interfere with the doctor blade setting.

The prior ink sealing arrangements for printing presses of this type have included (1) seals which overlap the ends of the cylinder, (2) seals which engage the outer surface of the cylinder and the end edges of the doctor blade and the ink dam, and (3) individual seals which close off the area at the ends of the ink chamber and engage the cylinder, doctor blade and ink dam. None of these sealing arrangements has proven entirely satisfactory.

The arrangement (1) above is plagued with leakage problems, particulary, leakage through the gap between the seal and the cylinder. Moreover, due to the tendency of the cylinder to sling ink, it requires an ink retainer and shield. It is critical to install since the gaps must be maintained, and it cannot be used for intermediate seals in split fountains.

The arrangement (2) above also has its leakage problems, particularly, leakage between the doctor blade and the seal. Also, as the pressure increases within the fountain, leakage occurs through the seal causing slinging of ink by the cylinder. The arrangement also requires an ink retainer to catch the ink slung by the cylinder, but even so, the arrangement produces troublesome clean-up problems.

The arrangement (3) above results in leakage under the seal, particularly, as the ink pressure is increased. Moreover, it is not adapted to split fountain arrangements. Also, if ink leaks through the seal, this results in the slinging of ink by the cylinder. If the seal is rigid, it will interfere with the doctor blade setting.

The ink sealing assembly of the present invention embodies an inner pressure barrier in communication with the ink chamber, at least one ink seal spaced apart from the pressure barrier on the side remote from the ink chamber, both having sealing edges contoured to engage the doctor blade, the ink dam and the outer periphery of the cylinder intermediate the doctor blade and the ink dam, and means establishing communication between the space or spaces intermediate the sealing edges and the return conduit to the reservoir.

The pressure barrier maintains the pressure within the ink chamber, and at the same time meters a discharge of ink from the ink chamber to the space intermediate the pressure barrier and the ink seal from which the ink returns to the reservoir through the return conduit. A pressure drop is thereby produced so that the ink seal does not have to resist the full pressure within the ink chamber.

In a preferred embodiment of the ink seal assembly of the present invention, the sealing arrangement includes a plurality of spaced apart flexible ink seals in which the edges engaging the doctor blade and the cylinder are deflected toward the ink cylinder so that the pressure within the ink chamber will tend to deflect them against the surface of the doctor blade and cylinder and increase the effectiveness of their sealing action.

The ink seal assembly of the present invention provides an effective seal for the ink chamber within the fountain. It eliminates leakage and ink slinging by the cylinder and the need for additional components, such as ink retainers and shields. Since the seals and pressure barrier are preferably flexible, they tend to self-adjust during wear and do not interfere with the doctor blade setting. Moreover, due to the flexibility and the ink metering capability of the pressure barrier, a more uniform pressure and ink flow can be maintained across the ink chamber, and pressure build-up in the ink blockage will be minimized.

A further advantage of the ink seal assembly of the present invention is that because it can be readily bolted to the ink fountain at the ends of the ink chamber or at other positions across the length of the ink chamber, it can be readily used for split fountains to provide seals between the different color inks.

For a more complete understanding of the present invention, reference can be made to the detailed description that follows and to the accompanying drawings, in which.

Figure 1:
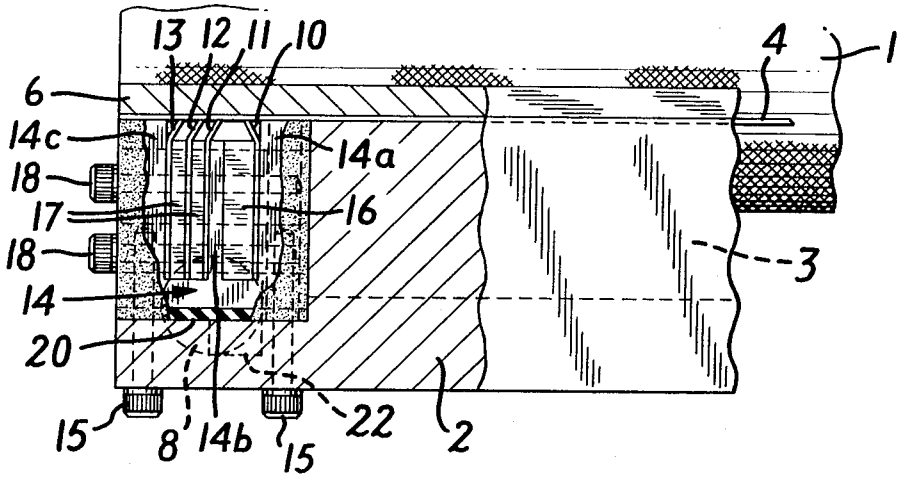
FIG. 1 is a fragmentary plane view of an ink fountain embodying the ink sealing assembly of the present invention with part of the fountain broken away above the ink seal assembly.
Figure 2:
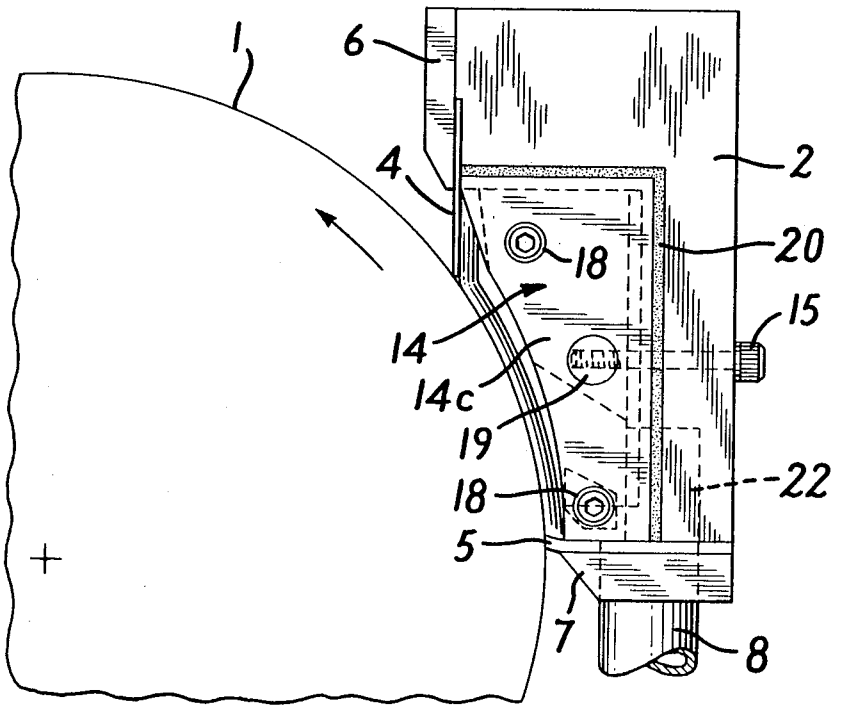
FIG. 2 is a side elevation of the ink fountain and the ink seal assembly; and, FIG. 3 is a cross-sectional elevation view of the ink sealing assembly viewed from the ink chamber.

Referring to the drawings, the ink seal assembly of the present invention is shown installed in a printing press in which an inking cylinder 1 rotates in tangential relation with a printing or plate cylinder (not shown).

The inking cylinder 1 has ink applied to the outer periphery thereof by an ink fountain 2 which contains an ink chamber 3. The ink chamber is in open communication with the inking cylinder across substantially the entire length of the cylinder. A doctor blade 4 defines the upper ink barrier for the ink chamber, and an ink dam 5 defines the lower ink barrier for the ink chamber. The doctor blade 4 and the ink dam 5 are mounted to the ink fountain by clamps 6 and 7, respectively. The ink sealing assembly of the present invention is shown forming an end seal for the ink chamber.

In the printing operation, ink from the reservoir (not shown) is pumped under pressure to the inking chamber where it is retained under pressure in engagement with the surface of the rotating cylinder. The ink is returned to the reservoir by gravity through a return conduit 8. The doctor blade 4 engages the ink cylinder and removes excess ink from surface thereof before the surface of the inking cylinder is brought into engagement with the surface of the printing cylinder.

The ink seal assembly of the present invention, in its preferred embodiment, includes a thin, relatively stiff but flexible pressure barrier 10 at one end of the ink chamber and three thin, relatively stiff but flexible seals 11, 12, 13 mounted within a rigid mounting block 14 which is anchored to the fountain by bolts 15. The pressure barrier 10 and the seals 11, 12, 13 are thin sheets of polymeric material, such as Mylar, and the block 14 is also made of polymeric material, such as nylon or polyethylene.

The pressure barrier 10 is accommodated in a slot formed in the front of the mounting block 14, the slot being defined between the walls **14*a* and 14*b* of the block. A rigid spacer 16 is accommodated in the slot between the pressure barrier and the wall 14*b***.

The seals 11, 12, 13 are accommodated in a slot formed in the front of the mounting block 14, the slot being defined between the walls **14*b* and 14*c* of the block. Rigid spacers 17 are accommodated in the slot between the seals 11, 12 and 12, 13**.

The pressure barrier 10, seals 11, 12, 13 and spacers 16 and 17 are held in proper place relative to each other and the mounting block 14 by a pair of bolts 18 which extend across the mounting block from the outer wall **14*c* to the inner wall 14*a* thereof. A steel pin 19 also extends across the block 14, and the steel pin 19 contains the threaded holes to accommodate the ends of the bolts 15. A gasket 20 is interposed between the block 14** and the recess within the ink fountain which accommodates the ink seal assembly.

The flexible sealing edges of the seals 11, 12, 13 are contoured to be in sealing engagement with the inner face of the doctor blade 4, the upper surface of the ink dam 5 and the outer periphery of the inking cylinder intermediate the doctor blade and the ink dam, thus providing three continuous, effective ink seals at the end of the ink chamber. The sealing edges engaging the doctor blade and cylinder are pre-shaped to deflect inwardly toward the ink chamber (FIG. 1) so that pressure or flow of ink from the ink chamber will tend to deflect the seals toward the surfaces which they engage and increase their sealing effect. Since the seals are flexible, the doctor blade can be adjusted while maintaining the sealing engagement between the seals and the doctor blade.

Figure 3:
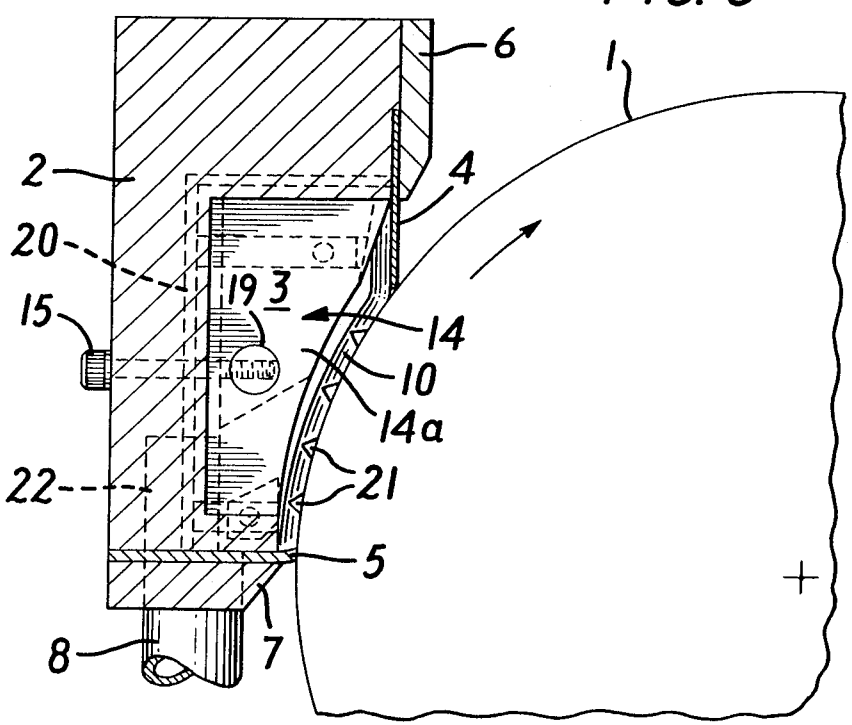

The pressure barrier 10 provides a barrier between the ink chamber and the ink return conduit 8. The pressure barrier has a flexible sealing edge which, like the flexible sealing edges of the seals, is contoured to engage the inner face of the doctor blade 4, the upper surface of the ink dam 5 and the outer periphery of the inking cylinder intermediate the doctor blade and the ink dam. The barrier contains apertures or notches 21 (See FIG. 3) along the sealing edge so that a metered flow of ink can be maintained from the ink cylinder through an aperture in the gasket 20 to a chamber 22 in the fountain behind the ink seal assembly. This chamber 22 communicates with the return conduit 8.

The sealing edge of the pressure barrier 10 engaging the doctor blade and the inking cylinder is pre-shaped to deflect outwardly away from the ink chamber (FIG. 1) so that if pressure increases within the ink chamber, notwithstanding the metered flow through the notches 21, relief can be provided by the deflection of the pressure barrier away from the doctor blade and inking cylinder to allow more ink to flow to the return conduit 8.

The pressure in the space between the sealing edges of the pressure barrier 10 and the seal 11 will be relatively low in relation to the pressure in the ink chamber because this space is in communication with the return conduit. The inking cylinder will still be inked due to the ink flow along its surface. Thus, the pressure barrier maintains the level of pressure within the ink chamber and reduces the pressure on the seals.

The spaces between the seals 11, 12 and 12, 13 provide an additional two-stage labyrinth arrangement, both stages of which are connected to the return conduit 8. Ink which leaks past the first seal 11 to the first stage will drain away. This will result in another pressure drop. If any ink leaks past the seal 12 into the space between the seals 12 and 13, it will result in another pressure drop and drain away. The seal 13 is the final seal of the labyrinth, and the space between the seals 12, 13 is the last communication with the return conduit 8.

If the ink chamber is in communication with substantially the entire length of the inking cylinder, an ink sealing assembly will be provided at both ends of the cylinder. On the other hand, in a split fountain arrangement, for example, where the ink chamber is to be subdivided to ink separate sections of the inking cylinder with different colors, a pair of ink sealing assemblies may be provided for each section.

The invention has been shown in a single preferred form and by way of example only, and many variations and modifications can be made therein within the spirit of the invention. The invention, therefore, is not intended to be limited to any specified form or embodiment, except in so far as such limitations are expressly set forth in the claims.

I claim:

1. An ink sealing assembly for a printing press in which ink is circulated from a reservoir into an ink chamber where it is retained under pressure in engagement with a rotating cylinder and returned through a return conduit to the reservoir and in which a doctor blade defines an ink barrier for the ink chamber characterized in that the ink sealing assembly comprises a pressure barrier communicating with the ink chamber, an ink seal spaced apart from said pressure barrier on the side remote from the ink chamber, said pressure barrier and ink seal each having an edge which engages the doctor blade and the outer periphery of the cylinder in communication with the ink chamber and means establishing communication between the space intermediate the said edges of the pressure barrier and ink seal and the return conduit to the reservoir.

2. An ink sealing assembly as set forth in claim 1 in which the printing press includes an ink dam and the doctor blade and ink dam define upper and lower barriers for the ink chamber and in which the sealing edges of the pressure barrier and ink seal make continuous engagement with the doctor blade, ink dam and the portion of the surface of the cylinder therebetween.

3. An ink sealing assembly as set forth in claim 1 in which there is a plurality of spaced apart ink seals and in which the spaces between them are in communication with the return conduit.

4. An ink sealing assembly as set forth in claim 3 including a mounting block for accommodating the pressure barrier and ink seals.

5. An ink sealing assembly as set forth in claim 1 in which the pressure barrier has ink metering flow passages formed in said edge so as to meter the flow of ink from the ink chamber to the space intermediate the pressure barrier and the ink seal.

6. An ink sealing assembly as set forth in claim 1 in which the sealing edge of the pressure barrier which engages the doctor blade and the cylinder is deflected away from the ink chamber so that an increase in pressure in the ink chamber is capable of increasing the flow of ink through the pressure barrier.

7. An ink sealing assembly as set forth in claim 1 in which the sealing edge of the ink seal which engages the doctor blade and the cylinder is deflected toward the ink chamber so that an increase in pressure in the space between the ink seal and the pressure barrier will increase the sealing effect of the ink seal on the doctor blade and the cylinder.

8. An ink sealing assembly as set forth in claim 1 in which the pressure barrier and ink seal are thin sheets of stiff but flexible, polymeric material having their sealing edges in sealing engagement with and contoured to the doctor blade and the cylinder, whereby the sealing engagement will not interfere with the setting of the doctor blade.

9. An ink sealing assembly as set forth in claim 3 in which the spaces between the pressure barrier and the spaced apart ink seals provide a multi-stage labyrinth in which the pressure drops from stage to stage as the distance from the ink chamber increases.

10. An ink sealing assembly as set forth in claim 4 in which the printing press includes an ink fountain containing the ink chamber and including means for locking the mounting block in the ink fountain to provide an end seal for the ink chamber.

11. An ink sealing assembly as set forth in claim 10 including means for locking the mounting block in the ink fountain at a location intermediate the ends of the ink fountain to provide a split fountain.

12. An ink sealing assembly as set forth in claim 4 including spacer means accommodated in the mounting block adjacent the pressure barrier and the ink seals and means locking the pressure barrier, ink seals and spacer means within the mounting block in proper relation to each other.

* * * * *